US006277794B1

(12) United States Patent
Dunn

(10) Patent No.: US 6,277,794 B1
(45) **Date of Patent: *Aug. 21, 2001**

(54) LUBRICANT COMPOSITIONS

(75) Inventor: Adrian Dunn, Faringdon (GB)

(73) Assignee: Infineum USA L.P., Linden, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/221,097

(22) Filed: Dec. 28, 1998

(51) Int. Cl.[7] ..... C10M 141/12; C10M 159/22; C10M 159/24

(52) U.S. Cl. ..... 508/199; 508/185; 508/391; 508/586

(58) Field of Search ..... 508/199, 185, 508/391, 586

(56) References Cited

U.S. PATENT DOCUMENTS

| | | | | |
|---|---|---|---|---|
| 1,726,647 | | 9/1929 | Cadwell . | |
| 1,736,429 | | 11/1929 | Cadwell . | |
| 2,599,350 | | 6/1952 | Rudel et al. . | |
| 2,945,749 | | 7/1960 | Andress, Jr. . | |
| 3,303,130 | | 2/1967 | Scypinski et al. . | |
| 3,878,115 | * | 4/1975 | Souillard et al. | 252/33.4 |
| 3,920,567 | | 11/1975 | Miller . | |
| 4,234,435 | | 11/1980 | Meinhardt et al. . | |
| 4,283,294 | * | 8/1981 | Clarke | 252/32.7 R |
| 4,420,407 | | 12/1983 | Sung et al. . | |
| 4,492,640 | | 1/1985 | Horodysky et al. . | |
| 4,584,115 | | 4/1986 | Davis . | |
| 4,670,169 | | 6/1987 | Adams et al. . | |
| 4,755,311 | | 7/1988 | Burjes et al. . | |
| 4,758,362 | | 7/1988 | Butke . | |
| 4,758,363 | * | 7/1988 | Sung et al. | 252/52.5 R |
| 4,764,296 | | 8/1988 | Kennedy . | |
| 4,770,807 | | 9/1988 | Musikas et al. . | |
| 4,808,335 | * | 2/1989 | Sung et al. | 252/47.5 |
| 4,842,755 | | 6/1989 | Dunn . | |
| 4,876,374 | | 10/1989 | Adams . | |
| 4,948,522 | * | 8/1990 | Dunn et al. | 252/32.7 E |
| 4,997,969 | | 3/1991 | Luciani . | |
| 5,259,967 | | 11/1993 | Ripple . | |
| 5,523,007 | * | 6/1996 | Kristen et al. . | |
| 5,827,806 | * | 10/1998 | Skinner et al. . | |
| 6,008,165 | * | 12/1999 | Shanklin et al. | 508/185 |
| 6,010,986 | * | 1/2000 | Stachew et al. | 508/185 |
| 6,103,672 | * | 8/2000 | Dunn et al. | 508/185 |

FOREIGN PATENT DOCUMENTS

| | | |
|---|---|---|
| 310 366 | 4/1989 | (EP) . |
| 331359 | 9/1989 | (EP) . |
| 0 369 804 | 5/1990 | (EP) . |
| 0 708 171 | 4/1996 | (EP) . |
| 2 121 432 | 12/1983 | (GB) . |
| WO 86/06092 | 10/1986 | (WO) . |
| WO 87/07638 | 12/1987 | (WO) . |
| WO 97/46647 | 12/1997 | (WO) . |
| WO 98/50501 | 11/1998 | (WO) . |

* cited by examiner

*Primary Examiner*—Jerry D. Johnson

(57) ABSTRACT

A marine diesel engine lubricant composition having a TBN of at least 10 and preferably a VI of at least 90, comprises a major amount of oil of lubricating viscosity, and admixed therewith, minor amounts of an ashless antiwear additive and a metal detergent in the form of (i) an overbased metal detergent having a TBN at least 300, preferably at least 330, more preferably at least 400, and comprising a surfactant system derived from at least two surfactants, and/or (ii) a metal detergent other than (i);

provided that, if detergent (ii) is present, the composition does not contain a minor amount of an extreme pressure additive, being up to 5.0 mass % based on the total mass of the composition.

16 Claims, No Drawings

LUBRICANT COMPOSITIONS

This invention relates to an improved lubricating oil composition for marine applications, such as a marine diesel cylinder lubricant (MDCL) suitable for cross-head diesel engines. More particularly, this invention relates to a finished lubricant formulation exhibiting improved piston ring and liner wear performance.

The lubrication of cross-head diesel engines, in particular the cylinder liners and piston rings of such engines, presents problems because the operating temperatures and pressures can lead to breakdown of the film of lubricant on the internal walls of the cylinder liners. When this occurs, the cylinder liners and/or piston rings may wear excessively.

EP-A-369,804 describes a method of lubricating a cross-head engine which comprises lubricating the engine with a lubricant composition comprising a major amount of base oil and minor amounts of an anti-wear additive and of an extreme-pressure additive. It states that the amount of extreme pressure additive should be sufficient to provide an extreme pressure effect, usually up to 5.0 mass % based on the total weight of the composition. Thus, EP-A-369,804 teaches the need for a combination of an extreme-pressure additive and an anti-wear additive to achieve effectiveness.

The present invention solves the above problem by lubricating a marine diesel engine with at least one ashless anti-wear additive without need for minor amounts of an extreme pressure additive, whilst providing effective anti-wear performance under the high temperature and high pressure conditions of the cylinder liners and piston rings of marine diesel engines; furthermore, EP-A-369,804 describes the use, as co-additives, of overbased 250 TBN calcium phenate in combination with overbased 300 TBN calcium sulfonate. The present invention also provides the particularly effective use of combination with a minor amount of an ashless anti-wear additive.

Accordingly, a first aspect of the present invention is a marine diesel engine lubricant composition having a TBN of at least 10, such as at least 20, and preferably a viscosity index of at least 90, preferably at least 100, more preferably at least 110, the composition comprising, or being provided by admixing, a major amount of oil of lubricating viscosity and a minor amount of A) an ashless antiwear additive; and B) a metal detergent in the form of (i) an overbased metal detergent having a TBN at least 300, preferably at least 330, more preferably at least 400, and comprising a surfactant system derived from at least two surfactants, and/or (ii) a metal detergent other than (i);

provided that, if detergent (ii) is present, the composition does not contain a minor amount of an extreme pressure additive, being up to 5.0 mass % based on the total mass of the composition.

A second aspect of the present invention is a method of making a marine diesel engine lubricant composition having a TBN of at least 10, such as at least 20, and preferably a viscosity index of at least 90, preferably at least 100, more preferably at least 110, comprising blending a major amount of oil of lubricating viscosity and minor amounts of (A) and (B) as defined in the first aspect of the invention, provided that, if detergent (ii) is blended, a minor amount of an extreme pressure agent, being up to 5.0 mass % based on the total mass of the composition, is not blended.

Preferably, in respect of use of metal detergent (B) (ii), the extreme pressure additive, if used, is not present in an amount up to 5.0, 4, 3, 2 or 1, mass % based on the mass of the lubricant composition. More, preferably, the extreme pressure additive is absent, and is absent also in respect of use of metal detergent (B) (i).

In contrast to antiwear additives, which protect against friction and wear under moderate boundary conditions, an extreme-pressure additive prevents the welding of mating surfaces that occurs at the exceedingly high local temperatures developed when opposing bodies are rubbed together under sufficient load. The latter form of protection is effective only under conditions of high local temperature. Thus, an extreme-pressure additive is essentially an extreme-temperature additive. The aforementioned EP-A-369,804 describes extreme pressure additives, as does J. A. Williams in "Engineering Tribology" (Oxford University Press, 1994), ps 354–357. The latter reference states that the real function of extreme-pressure additives is to lubricate at comparatively high temperatures, perhaps up to as much as 300–400° C.; in contrast, anti-wear additives lubricate at lower temperatures and, according to the latter reference, act in a different way.

A third aspect of the present invention is a marine diesel engine lubricant composition comprising, or being provided by admixing, a major amount of oil of lubricating viscosity and a minor amount of (A) comprising a sulfur-containing boroester compound having the general formula (I):

(I)

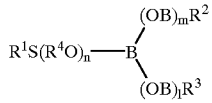

wherein $R^1$ represents a hydrocarbyl group having from 4 to 12 carbon atoms, $R^2$ and $R^3$ independently represent $—(OR^4)_nSR^1$ or $—(OR^4)_nSR^1OH$; $R^4$ represents a hydrocarbyl group having from 1 to 6 carbon atoms; n is an integer of from 1 to 4; and l and m are independently 0, 1 or 2;

a cyclic metaborate ester having the general formula (II):

(II)

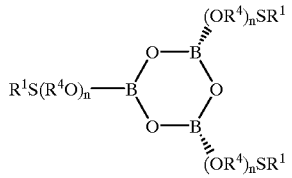

wherein n, $R^1$ and $R^4$, are defined as in formula (I); or a mixture of a borate ester of formula (I) and a metaborate ester of formula (II), and (B) a metal detergent.

A fourth aspect of the present invention is a method of making a marine diesel engine lubricant composition comprising blending a major amount of oil of lubricating viscosity and a minor amount of an additive as defined in the third aspect of the present invention.

A fifth aspect of the present invention is a method of reducing the piston ring and cylinder liner wear of a marine diesel engine, the method comprising lubricating the engine with a lubricant composition according to the first or third aspects of this invention, or made by the method according to the second or fourth aspects of this invention.

A sixth aspect of the present invention is the use of a lubricant composition to reduce the piston ring and cylinder liner wear of a marine diesel engine which comprises lubricating the engine with a lubricant composition according to the first, or third aspects of this invention, or made by the method according to the second or fourth aspects of this invention.

A seventh aspect of the present invention is a method of lubricating a marine diesel engine which comprises supplying to the engine a marine diesel engine lubricant composition according to the first or third aspects of the invention, or made by the method according to the second or fourth aspects of the invention. In performing the seventh aspect of the invention, the engine may be supplied with a fuel having a sulfur-content, expressed as elemental sulfur, of not greater than 1.5, such as 0.5 to 1, mass %.

In this specification, TBN (Total Base Number) is as measured by ASTM D2896, and viscosity index is as defined by ASTM D2270.

In this specification, unless otherwise stated, proportions of additives are quoted in terms of the proportion of active ingredient thereof, sometimes referred to as "a.i.", e.g. such proportions do not include diluent.

In this specification, by "hydrocarbyl" is meant a group that is connected to the remainder of the molecular via a carbon atom, that contains hydrogen and carbon atoms, and that may contain atoms other than hydrogen and carbon, such as hetero atoms, provided they do not interfere with the essentially hydrocarbon nature of the group.

The features of the invention will now be discussed in more detail.

Marine Diesel Engines

The lubricant composition of the present invention may be suitable for use in a 4-stroke trunk piston diesel engine such as having an engine speed of 200–2,000, e.g. 400–1,000, rpm, and a brake horse-power (BHP) per cylinder of 50–3,000, preferably 100–2,000. It may also be suitable for use in a 2-stroke cross-head diesel engine such as having a speed of 40–200, preferably 60–120 rpm and a BHP per cylinder of 500–10,000. The above engine types may be referred to as medium—and slow-speed diesel engines respectively. Preferably, the engine is a cross-head diesel engine.

Lubricant Composition

Preferably, the TBN of the lubricant composition is at least 40, for example in the range of from 60 to 100. Preferably, the viscosity index of the lubricant composition is at least 115, more preferably at least 120, and at most 180 such as 150, preferably 130. A preferred viscosity index range is from 120 to 130.

The lubricant composition may, for example, have a kinematic viscosity at 100° C. (as measured by ASTM D445) of at least 14, preferably at least 15, more preferably in the range of from 17 to 30, for example from 17 to 25, $mm^2/s$.

The composition may be prepared by adding to the oil of lubricating viscosity a mixture of, or separately, minor amounts of the additives defined and described herein and, if necessary, one or more co-additives such as described hereinafter. Additives may be added directly or in the form of concentrates, including so-called "adpacks", as known in the art.

Lubricating Oil

The oil of lubricating viscosity (sometimes referred to as lubricating oil) may be any oil suitable for the lubrication of a cross-head engine or a trunk piston engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The lubricating oil may generally comprise greater than 60, typically greater than 70, % by mass of the composition, and typically have a kinematic viscosity at 100° C. of from 2 to 40, for example from 3 to 15, $mm^2/s$, and a viscosity index of from 80 to 100, for example from 90 to 95.

Another class of lubricating oils comprises hydrocracked oils, formed where the refining process further breaks down the middle and heavy distillate fractions in the presence of hydrogen at high temperature s and moderate pressures. Hydrocracked oils typically have kinematic viscosity at 100° C. of from 2 to 40, for example from 3 to 15, $mm^2/s$ and a viscosity index typically in the range of from I100 to 110, for example from 105 to 108.

Base oils which are solvent-extracted and de-asphalted products from vacuum residuum generally having a kinematic viscosity at 100° C. of from 28 to 36 $mm^2/s$ are also suitable for use in the prevent invention. They are typically used in a proportion of less than 30, preferably less than 20, more preferably less than 15, most preferably less than 10, such as less than 5, mass %, based on the mass of the composition.

The terms 'oil-soluble' or 'oil-dispersible' as used herein do not necessarily indicate that the compounds or additives are soluble, dissolvable, miscible or capable of being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined components that may or may not remain the same chemically before and after mixing.

(A) Ashless Anti-Wear Additive

As used herein, the term 'ashless' refers to additives that are metal-free.

Ashless anti-wear additives protect against wear by reacting chemically with the metal surface to form a protective coating that allows the moving parts to slide across each other with minimum loss of wear.

Ashless anti-wear additives may be selected from sulfur-, phosphorus-, or boron-containing additives and mixtures thereof.

Examples of sulfur-containing ashless anti-wear additives are thiocarbamate-containing compounds, such as thiocarbamate esters, thiocarbamate amides, thiocarbamic ethers, alkylene-coupled thiocarbamates, and bis(S-alkyldithiocarbamyl) disulfides.

The dithiocarbamate-containing compounds may be prepared by reacting a dithiocarbamate acid or salt with an unsaturated compound. The dithiocarbamate-containing compounds may also be prepared by simultaneously reacting an amine, carbon disulfide and an unsaturated compound. Generally, the reaction occurs at a temperature from 25 to 125° C. U.S. Pat. Nos. 4,758,362 and 4,997,969 describe dithiocarbamate compounds and methods of making them.

The dithiocarbamate acid or salt which may be used to prepare the dithiocarbamate-containing compounds may be prepared by reacting an amine with carbon disulfide. The amines may be primary or secondary amines, secondary amines being preferred. The amines generally may contain hydrocarbyl groups. Each hydrocarbyl group may independently contain from one up to 40, or from two up to 30, or from three up to 24, or even up to 12, carbon atoms.

Examples of primary amines useful in the present invention include ethylamine, propylamine, butylamine, 2-ethylhexylamine, octylamine and dodecylamine.

Also suitable are primary fatty (C.) amines which include n-octylamine, n-decylamine, n-dodecylamine, n-tetradecylamine, n-hexadecylamine, n-octadecylamine and oleyamine. Other useful fatty amines include commercially available fatty amines such as 'Armeen' (RTM) amines (products available from Akzo Chemicals, Chicago, Ill.), such as Akzo's Armeen C, Armeen O, Armeen OL, Armeen T, Armeen HT, Armeen S and Armeen SD, wherein the letter designation relates to the fatty group, such as coco, oleyl, tallow, or stearyl groups.

Other useful primary amines include primary ether amines, such as those represented by the formula, $R^{11}RO^1)_x NH_2$, wherein $R^1$ represents a divalent alkylene group having 2 to 6 carbon atoms; x is a number from one to 150, or from one to five, or one; and $R^{11}$ represents a hydrocarbyl group of 5 to 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$) of the SURFAMS described above are approximate and include the oxygen ether linkage.

The amine may also be a tertiary-aliphatic primary amine. Generally, the aliphatic group, preferably an alkyl group, contains from 4 to 30, or from 6 to 24, or from 8 to 22, carbon atoms. Usually the tertiary alkyl primary amines are monoamines represented by the formula $R_1—C(R_1{}^1)_2—NH_2$, wherein $R_1{}^1$ represents a hydrocarbyl group containing from one to 27 carbon atoms and each $R_1{}^1$ independently represents a hydrocarbyl group containing from 1 to 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of amines are also useful. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known in the art. The tertiary alkyl primary amine useful for the purposes of this invention and methods for their preparation are described in U.S. Pat. No. 2,945,749.

Specific secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

Dithiocarbamate amide compounds may be prepared by reacting one or more dithiocarbamic acids or salts with an unsaturated amide. The reaction products of dithiocarbamic acids and salts with unsaturated amides are disclosed in U.S. Pat. Nos. 4,758,362 (Butke) and 4,997,969 (Luciani).

Dithiocarbamate ether compounds include reaction products of a dithiocarbamic acid or salt with an unsaturated acid, anhydride or ester.

Dithiocarbamate ethers also include reaction products of a dithiocarbamic acid or salt and a vinyl ether.

Alkylene coupled dithiocarbamates, useful in the present invention, may be prepared by the reaction of a salt of a dithiocarbamic acid with a suitable dihalogen containing hydrocarbon. The reaction is generally carried out at a temperature within the range from 25 up to 150, or up to 100° C. U.S. Pat. No. 3,876,550 describes alkylene dithiocarbamate compounds, and U.S. Pat. Nos. 1,726,647 and 1,736,429, describe phenylmethylene bis(dithiocarbamates) and methods of making them.

Bis(S-alkyldithiocarbamoyl) disulfides, or sulfur-coupled dithiocarbamates, may be prepared by (A) reacting a sulfur halide with a stoichiometric equivalent of (i) at least one olefinic hydrocarbon, or (ii) an aldehyde or ketone, at a temperature and for a period of time sufficient to produce a di(halohydrocarbyl) sulfide intermediate or a dialdehyde or diketo sulfur intermediate, and (B) reacting the intermediate with a salt of a dithiocarbamate in an amount sufficient generally to replace both halo groups with the dithiocarbamate groups or to react with both carbonyl groups of the dialdehyde or diketone. The sulfur halide utilised in the first step (A) may be sulfur monochloride (i.e., $S_2Cl_2$), sulfur dichloride, sulfur monobromide, sulfur dibromide, or mixtures of any of the above sulfur halides with elemental sulfur in varying amounts.

The bis(S-alkyldithiocarbamoyl) disulfides may also be prepared by a process which comprises the steps of (A) reacting an olefinic hydrocarbon with a halogen to produce a halogen-containing intermediate, and (B) reacting said intermediate with an alkali metal sulfide and a salt of a dithiocarbamate in an amount sufficient to replace the halogen groups present partially with dithiocarbamate groups and/or partially with sulfide groups. The bis(S-alkyldithiocarbamoyl) disulfides are described in U.S. Pat. No. 2,599,350.

Examples of phosphorous-containing ashless anti-wear additives are phosphoric acid esters; phosphites; and phosphorus-containing carboxylic acids, esters, ethers, or amides. The phosphorus acids include the phosphoric, phosphonic, phosphinic and thiophosphoric acids including dithiophosphoric acids as well as the monothiophosphoric acids, thiophosphinic and thiophosphonic acids.

The phosphorus acid esters may be prepared by reacting one or more phosphorus acids or anhydrides with an alcohol containing from one, such as from 3, carbon atoms. The alcohol generally contains up to 30, such as up to 24, such as up to 12, carbon atoms The phosphorus acid or anhydride may generally be an inorganic phosphorus reagent, such as phosphorus pentoxide, phosphorus trioxide, phosphorus tetroxide, phosphoric acid, phosphorous acid, phosphorus halide, lower phosphorus esters, or a phosphorus sulfide, including phosphorus pentasulfide.

Examples of useful phosphorus acid esters include the phosphoric acid esters prepared by reacting a phosphoric acid or anhydride with cresol alcohols. An example of such phosphorus acid esters is tricresylphosphate.

Monothiophosphates may be prepared by the reaction of a sulfur source with a dihydrocarbyl phosphite. The sulfur source may for instance be elemental sulfur. The sulfur source may also be a monosulfide, such as a sulfur coupled olefin or a sulfur coupled dithiophosphate. Elemental sulfur is a preferred sulfur source. The preparation of monothiophosphates is described in U.S. Pat. No. 4,755,311 and PCT Publication WO 87/07638.

The amine salts of the phosphorus acid esters may be formed from ammonia, or an amine, including monoamines and polyamines. The amines may be primary amines, secondary amines or tertiary amines. Useful amines include those amines disclosed in U.S. Pat. No. 4,234,435 at col. 21, line 4 to col. 27, line 50.

Phosphorus-containing amides may be prepared by the reaction of one of the above-described phosphorus acids, preferably a dithiophosphoric acid, with an one of the above-described unsaturated amides. The reaction product of the phosphorus acid and the unsaturated amide may be further reacted with a linking or a coupling compound, such as formaldehyde or paraformaldehyde. Phosphorus containing amides are known in the art and are disclosed in U.S. Pat. Nos. 4,670,169, 4,770,807 and 4,876,374.

Phosphorus-containing carboxylic esters may be prepared by reaction of one of the above-described phosphorus acids, preferably a dithiophosphoric acid, and one of the above-described unsaturated carboxylic acids or esters. If a carboxylic acid is used, the ester may then be formed by subsequent reaction of the phosphoric acid-unsaturated carboxylic acid adduct with an alcohol, such as those described above for phosphorus acid esters.

Examples of boron-containing ashless anti-wear additives are borate esters, borated fatty amines, borated epoxides, and borated phospholipids.

Borated amines may be prepared by reacting one or more of the above boron compounds, such as boric acid or borate ester, with a fatty amine, e.g., an amine having from 4 to 18 carbon atoms.

Borated fatty epoxides are generally the reaction products of one or more of the above boron compounds with at least one epoxide. The borated fatty epoxides are generally known and are disclosed in U.S. Pat. No. 4,584,115.

Borated phospholipids may be prepared by reacting a combination of a phospholipid and a boron compound.

Borate esters may be synthesised from the reaction of a boron source, such as boric acid, and an alcohol. The alcohol may be a polyol, such as a 1,3-diol and may have up to 24 carbon atoms, and may contain other atoms, such as sulfur.

Further, EP-A-0216909 discloses antiwear agents that are esters of metaboric acid, and have the following formula:

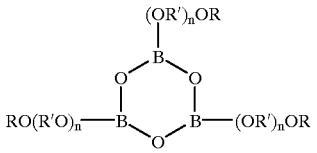

wherein each R independently represents hydrogen or a hydrocarbyl group containing from 1 to 18 carbon atoms and each R' independently represents an alkylene group containing from 2 to 4 carbon atoms.

Antiwear agents providing both boron and sulfur are disclosed, for example, in U.S. Pat. No. 3,303,130 which describes an organo thioalkyl borate antiwear agent of the general formula:

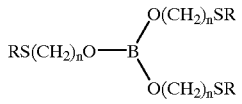

wherein R is selected from the group consisting of hydrogen, alkyl, aryl, alkaryl, aralkyl and cycloalkyl radicals containing 1 to 16 carbon atoms and n is an integer of 2 to 16, inclusive. These compounds are formed by reacting a thioalcohol with boric acid in a molar ratio of at least 3:1, and provide an antiwear additive having a weight ratio of sulfur to boron of 3.33:1. Similar compounds formed by reacting an alcohol, a hydroxysulfide and a boron compound, and the use thereof as a friction reducer in lubricating oil compositions are disclosed in U.S. Pat. No. 4,492,640.

Preferred examples of suitable borate esters comprising sulfur are those defined in the third aspect of the invention hereinbefore.

In formula (I) thereof, it is preferred that $R^1$ represents a hydrocarbyl group having from 6 to 9 carbon atoms, $R^4$ represents a hydrocarbyl group having from 2 to 4 carbon atoms, and that each of l, m and n is 1. More preferably, $R^1$ has 6 carbon atoms and $R^4$ has 2 carbon atoms.

In formula (II) thereof, it is preferred that $R^1$ represents a hydrocarbyl group having from 6 to 9 carbon atoms and $R^4$ represents a hydrocarbyl group having from 2 to 4 carbon atoms. More preferably, $R^1$ has 6 carbon atoms and $R^4$ has 2 carbon atoms.

The hydrocarbyl groups may be the same or different and are preferably alkyl groups.

The above-mentioned borate esters of formulae (I) and (II) may be made as the product of a condensation reaction of an alkoxyalkyl sulfide and boric acid in a molar ratio of at least about 1:1. Suitable alkoxyalkyl sulfides are compounds of formula (III):

$$R^1(SR^4)OH \qquad \text{(III)}$$

wherein $R^1$ and $R^4$ are defined as above, and n is an integer from 1 to 4. Preferable compounds of formula (III) include hydroxyethyldodecyl sulfide, 1-hydroxy-2-methyl-3-thiodecane and hydroxyethyloctyl sulfide (HEOS). The alkoxyalkyl sulfide can compromise a single compound or a mixture thereof.

When reacted with boric acid, the alkoxyalkyl sulfide will form a reaction product that can include both the compound of formula (I) and the compound of formula (II). The reaction strongly favours formation of the compound of formula (II) and the reaction product may, in fact, contain only insignificant amounts, or essentially no, compound of formula (I). The boric acid and hydroxalkyl sulfide are reacted in a molar ratio of about 1:1 or can be reacted in the presence of a slight molar excess of alkoxyalkyl sulfide (no greater than about 2:1). The reaction is conducted at a temperature within a range of from between 60 to 120° C., and at a pressure within a range from between −100 to 0, preferably from between −70 to −30, kPa.

The boric acid and hydroxalkyl sulfide may be reacted either neat or in an inert or non-participating polar solvent. Using hydroxyethyloctyl sulfide (HEOS) and boric acid reactants as examples, the reaction is believed to proceed as follows:

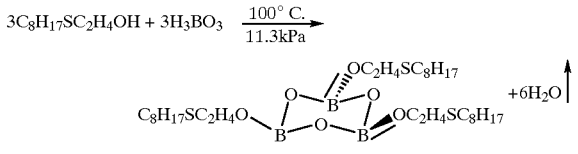

The borate ester may also be derived from glycerol, boric acid and a fatty acid having 8–24 carbon atoms, and may, for example, have one or more of the following formulae:

(II)

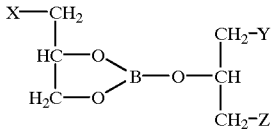

(III)

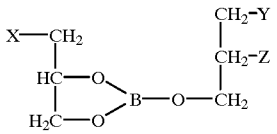

(IV)

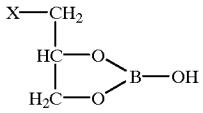

where X, Y and Z are the same or different and each represents a group selected from the group consisting of a hydroxyl group and an alkylcarboxyl group of formula —OCOR where R represents a straight chain or branched chain alkyl group of 7–23 carbon atoms which may be saturated or unsaturated.

Dithiocarbamates salts of boron, such as boron trisdithiocarbamates, are also ashless anti-wear additives of the present invention.

The ashless anti-wear additive may be present in an amount of at least 0.01, preferably at least 0.1, such as in the range of from 0.1 to 10, mass %, based on the mass of the lubricant composition.

(B) Metal Detergents

The metal detergents, including detergents (B) (ii), may be overbased and may include alkali metal and alkaline earth metal additives such as overbased oil-soluble or oil-dispersible calcium, magnesium, sodium or barium salts of a surfactant selected from phenol, sulfonic acid, carboxylic acid, salicylic acid and naphthenic acid, wherein the overbasing is provided by an oil-insoluble salt of the metal, e.g. carbonate, basic carbonate, acetate, formate, hydroxide or oxalate, which is stabilised by the oil-soluble salt of the surfactant. The metal of the oil-soluble surfactant salt may be the same as or different from the metal of the oil-insoluble salt. Preferably the metal, whether the metal of the oil-soluble or oil-insoluble salt, is calcium. Detergent B (ii) may be neutral.

The metal detergent may have a TBN of at least 200, preferably at least 250, especially at least 300, such as up to 600, with reference to detergents (B) (i) and (B) (ii) as appropriate.

Most preferably detergents B (i) have a TBN of at least 350 such as in the range of from 400 to 600, such as up to 500.

Surfactants for the surfactant system of the overbased metal compounds preferably contain at least one hydrocarbyl group, for example, as a substituent on an aromatic ring.

Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impart the desired oil-solubility.

Phenols for use in this invention may be non-sulfurised or, preferably sulfurised. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols may be derived from the formula

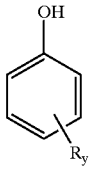

where R represents a hydrocarbyl group and y represents 1 to 4. Where y is greater than 1, the hydrocarbyl groups may be the same or different.

In lubricating oil overbased metal compounds, the phenols are frequently used in sulfurised form. Sulfurised hydrocarbyl phenols may typically be represented by the formula:

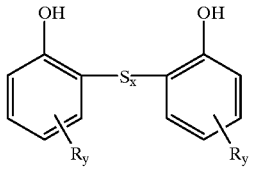

where x is generally from 1 to 4. In some cases, more than two phenol molecules may be linked by $S_x$ bridges.

In the above formulae, hydrocarbyl groups represented by R are advantageously alkyl groups, which advantageously contain 5 to 100, preferably 5 to 40, especially 9 to 12, carbon atoms, the average number of carbon atoms in all of the R groups being at least 9 to ensure adequate solubility in oil. Preferred alkyl groups are nonyl (tripropylene) groups.

In the following discussion, hydrocarbyl-substituted phenols will for convenience be referred to as alkyl phenols.

A sulfurising agent for use in preparing a sulfurised phenol or phenate may be any compound or element which introduces —$(S)_x$— bridging groups between the alkyl phenol monomer groups, wherein x is generally from 1 to about 4. Thus, the reaction may be conducted with elemental sulfur or a halide thereof, for example, sulfur dichloride or, more preferably, sulfur monochloride. If elemental sulfur is used, the sulfurisation reaction may be effected by heating the alkyl phenol compound at from 50 to 250, preferably at least 100° C. The use of elemental sulfur will typically yield a mixture of bridging groups —$(S)_x$— described above. If a sulfur halide is used, the sulfurisation reaction may be effected by treating the alkyl phenol at from −10 to 120, preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulfurising agent.

Where elemental sulfur is used as the sulfurising agent, it may be desirable to use a basic catalyst, for example, sodium hydroxide or an organic amine, preferably a heterocyclic amine (e.g., morpholine).

Details of sulfurisation processes are well known to those skilled in the art.

Regardless of the manner in which they are prepared, sulfurised alkyl phenols useful in preparing overbased metal compounds generally comprise diluent and unreacted alkyl phenols and generally contain from 2 to 20, preferably 4 to 14, most preferably 6 to 12, mass % sulfur based on the mass of the sulfurised alkyl phenol.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above provided that such substituents do not detract significantly from the surfactant properties of the phenols. Examples of such substituents are methoxy groups and halogen atoms.

Salicylic acids used in accordance with the invention may be non-sulfurised or sulfurised, and may be chemically modified and/or contain additional substituents, for example, as discussed above for phenols. Processes similar to those described above may also be used for sulfurising a hydrocarbyl-substituted salicylic acid, and are well known to those skilled in the art. Salicylic acids are typically prepared by the carboxylation, by the Kolbe-Schmitt process, of phenoxides, when they will generally be obtained (normally in a diluent) in admixture with uncarboxylated phenol.

Preferred substituents in oil-soluble salicylic acids from which overbased detergents in accordance with the invention may be derived are the substituents represented by R in the above discussion of phenols. In alkyl-substituted salicylic acids, the alkyl groups advantageously contain 5 to 100, preferably 9 to 30, especially 14 to 20, carbon atoms.

Sulfonic acids used in accordance with the invention are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from 7 to 100 or more carbon atoms. They preferably contain from 16 to 80, or 12 to 40, carbon atoms per alkyl-substituted aromatic moiety, depending on the source from which they are obtained.

When neutralising these alkylaryl sulfonic acids to provide sulfonates, hydrocarbon solvents and/or diluent oils may also be included in the reaction mixture, as well as promoters and viscosity control agents.

Another type of sulfonic acid which may be used in accordance with the invention comprises alkyl phenol sulfonic acids. Such sulfonic acids can be sulfurised. Whether sulfurised or non-sulfurised, these sulfonic acids are believed to have surfactant properties comparable to those of sulfonic acids, rather than surfactant properties comparable to those of phenols.

Sulfonic acids suitable for use in accordance with the invention also include alkyl sulfonic acids, such as alkenyl sulfonic acids. In such compounds the alkyl group suitably contains 9 to 100, advantageously 12 to 80, especially 16 to 60, carbon atoms.

Carboxylic acids which may be used in accordance with the invention include mono- and dicarboxylic acids. Preferred monocarboxylic acids are those containing 1 to 30, especially 8 to 24, carbon atoms. (Where this specification indicates the number of carbon atoms in a carboxylic acid, the carbon atom(s) in the carboxylic group(s) is/are included in that number.) Examples of monocarboxylic acids are iso-octanoic acid, stearic acid, oleic acid, palmitic acid and behenic acid. Iso-octanoic acid may, if desired, be used in the form of the mixture of $C_8$ acid isomers sold by Exxon Chemical under the trade name "Cekanoic" (RTM). Other suitable acids are those with tertiary substitution at the α-carbon atom, and dicarboxylic acids with more than 2 carbon atoms separating the carboxylic groups. Further, dicarboxylic acids with more than 35, for example, 36 to 100, carbon atoms, are also suitable. Unsaturated carboxylic acids can be sulphurised. Although salicylic acids contain a carboxylic group, for the purposes of the present specification they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the type hydrocarbyl-substituted carboxylalkylene-linked phenols, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708171.

Also suitable for use in the present invention are overbased metal compounds, preferably overbased calcium detergents, that contain at least two surfactant groups, such as phenol, sulfonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulfonic acid; an overbased calcium salt of surfactants phenol and carboxylic acid; an overbased calcium salt of surfactants phenol, sulfonic acid and salicylic acid; and an overbased calcium salt of surfactants phenol and salicylic acid.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole % of the cations in the oil-insoluble metal salt are calcium ions. Cations other than calcium may be derived, for example, from the use in the manufacture of the overbased detergent of a surfactant salt in which the cation is a metal other than calcium. Preferably, the metal salt of the surfactant is also calcium.

Where detergent (B) (ii) comprises at least two overbased metal detergents, any suitable proportions by mass may be used; preferably the mass to mass proportion of any one overbased metal detergent to any other overbased metal detergent is in the range of from 5:95 to 95:5, such as from 90:10 to 10:90, more preferably from 20:80 to 80:20, especially from 70:30 to 30:70, advantageously from 60:40 to 40:60.

Particular examples of hybrid materials include:

i) an overbased calcium detergent comprising a surfactant system derivable, and preferably derived, from at least two surfactants, at least one of which is a phenol or a derivative thereof and the other, or at least one other, of which is a surfactant other than a phenol surfactant, the proportion, measured as described herein, of said phenol in the surfactant system being at least 10 mass % and the overbased detergent having a TBN:% surfactant ratio (as hereinafter defined) of at least 10.

Independently of the TBN:% surfactant ratio, the proportion of phenol in the surfactant system is at least 20, preferably at least 40, more preferably at least 45, such as in the range of from 50 to 90, mass %. Independently of the phenol proportion, the TBN:% surfactant ratio is at least 11, preferably at least 14, more preferably at least 16, advantageously at least 16, especially at least 19, more especially at least 21, for example at least 25, such as up to 30 or more, or up to 40 or more.

ii) an overbased calcium detergent comprising a surfactant system derivable, and preferably derived, from at least two surfactants, at least one of which is a salicylic acid or a derivative thereof, and the other, or at least one other, of which is a surfactant other than a salicylic acid surfactant, the proportion, measured as described herein, of the said salicylic acid in the surfactant system being at least 10 mass %, and the overbased detergent having a TBN:% surfactant ratio (as hereinafter defined) of at least 10.

Independently of the TBN:% surfactant ratio, the proportion of salicylic acid in the surfactant system is at least 20, preferably at least 30, more preferably at least 45, such as in the range of from 50 to 90, mass %. Independently of the salicylic acid proportion, the TBN:% surfactant ratio is at least 11, preferably at least 14, more preferably at least 16, advantageously at least 18, especially at least 19, more especially at least 21, for example at least 25, such as up to 30 or more, or up to 40 or more.

iii) an overbased calcium detergent comprising a surfactant system derivable, and preferably derived, from phenol and sulfonic acid, the proportions, measured as described herein, of phenol to sulfonic acid in the surfactant system being in the range of from 15:85 to 95:15, preferably 30:70 to 70:30, especially 40:60 to 60:40, mass %; and the TBN:% surfactant ratio (as hereinafter defined) of at least 15, preferably at least 17, especially 19 or more.

iv) an overbased calcium detergent comprising a surfactant system derivable, and preferably derived, from phenol, salicylic acid and sulfonic acid, the proportions, measured as described herein, of phenol to salicylic acid to sulfonic acid in the surfactant system being in the range of from 5 to 90: 5 to 90: 20 to 80; preferably 20 to 80: 20 to 80: 10 to 50; more preferably 30 to 50: 25 to 50: 15 to 35, mass %: mass %: mass % and the TBN:% surfactant ratio (as hereinafter defined) of at least 10, preferably at least 12, especially 14 or more.

Typically, the amount of overbased metal compound in a lubricant composition is at least 0.5, particularly in the range of from 0.5 to 20, such as from 3 to 12 or 2 to 7, mass % active ingredient, based on the mass of the composition.

The overbased metal compounds of the present invention may be borated; typically the boron-contributing compound, e.g. the metal borate, is considered to form part of the overbasing.

The percentage of surfactant in the overbased calcium detergent, and the percentages of the individual surfactants, for example, phenol, in the surfactant system, are the percentages measured by the method set out below.

1. Dialysis of the Overbased Detergent

A known amount (A g, approximately 20 g) of the liquid overbased calcium detergent compound (substantially free from other lubricating oil additives) is dialysed through a membrane in a Soxhlet extractor (150 mm height×75 mm internal diameter) using n-hexane siphoning at a rate of 3 to 4 times per hour for 20 hours. The membrane should be one which retains substantially all the metal-containing material, and passes substantially all the remainder of the sample. An example of a suitable membrane is a gum rubber membrane supplied by Carters Products, Division of Carter Wallace Inc., New York, N.Y. 10105 under the trade name Trojans. The dialysate and residue obtained on completion of the dialysis step are evaporated to dryness, any remaining volatile material then being removed in a vacuum oven (100° C. at less than 1 torr or less than about 130 Pa). The mass of the dried residue, in grams, is designated B. The percentage (C) of overbased detergent material in the liquid sample is given by the equation:

$$C = \frac{B}{A} \times 100\%$$

Background information for the dialysis technique is given by Amos, R. and Albaugh, E. W. in "Chromatography in Petroleum Analysis", Altgelt, K. H. and Gouw, T. H., Eds, pages 417 to 422, Marcel Dekker, Inc., New York and Basel, 1979.

2. Determination of TBN: % Total Surfactant Ratio

A known amount (D g, approximately 10 g) of the dried residue is hydrolysed as specified in sections 8.1 to 8.1.2 of ASTM D3712, except that at least 200 ml of 25% by volume hydrochloric acid (sp. gr. 1.18) is used in section 8.1.1. The amount of hydrochloric acid used should be sufficient to effect acidification/hydrolysis of the overbased detergent residue into organic materials (surfactants) and inorganic materials (calcium-containing materials, for example, calcium chloride). The combined ether extracts are dried by passing them through anhydrous sodium sulphate. The sodium sulphate is rinsed with clean ether, and the combined ether solutions are evaporated to dryness (at approximately 110° C.) to yield a hydrolysed residue. The mass of the dried hydrolysed residue, in grams, is designated E.

The percentage, Y, of total surfactants in the original liquid overbased detergent is given by the equation $$Y = \frac{E}{D} \times C$$

and the TBN: % total surfactant ratio, X, is given by the equation $$X = \frac{TBN \text{ of the liquid overbased detergent}}{Y}$$

It will be noted that, in determining X, the mass of the surfactants in their free form (that is, not in the form of a salt or other derivative) is used.

3. Determination of Individual Surfactants (In Their Free Form) in the Surfactant System The techniques described below isolate the individual surfactants, in hydrolysed form, from the hydrolysed surfactant mixture derived from the overbased detergent. As indicated below, the proportion of each individual surfactant is the proportion by mass of the individual surfactant, in hydrolysed form, in the hydrolysed surfactant mixture. Thus, where, for example, the overbased detergent contains a calcium phenate/sulphonate/salicylate surfactant system, the proportions of the individual surfactants in the surfactant system are expressed as the proportions of phenol, sulphonic acid and salicylic acid respectively.

The proportions of individual surfactants may be determined by the following method.

A known amount (F g, approximately 1 g) of the dried hydrolysed residue obtained as described above is placed at the top of a 450×25 mm (internal diameter) fritted glass column filled with 60–100 US mesh Florisil. Florisil is magnesium silicate with a CAS number of 8014-97-9. The column is eluted with a 250 ml portion of each of seven solvents of increasing polarity, namely, heptane, cyclohexane, toluene, ethyl ether, acetone, methanol, and, lastly, a mixture of 50 volume % chloroform, 44 volume % isopropanol, and 6 volume % ammonia solution (sp. gr. 0.88). Each fraction is collected, evaporated to dryness, and the resulting residue is weighed and then analysed to determine the amount ($G^1$, $G^2$, $G^3$ . . . g) and nature of the surfactant(s) contained in the fraction.

Analysis of the fractions (or of the hydrolysed residue) can be carried out by, for example, chromatographic, spectroscopic, and/or titration (colour indicator or potentiometric) techniques known to those skilled in the art. Where the overbased detergent contains a sulphonate surfactant and a salicylate surfactant, the sulphonic acid and salicylic acid obtained by hydrolysis of these surfactants will usually be eluted from the column together. In this case, and in any other case where it is necessary to determine the proportion of sulphonic acid in a mixture containing it, the proportion of sulphonic acid in the mixture can be determined by the method described by Epton in Trans. Far. Soc. April 1948, 226.

In the above method, the mass (in grams, designated $H^1$) of a given surfactant, in hydrolysed form, is determined from the fraction(s) containing it, and thus the proportion of that surfactant in the surfactant system of the original overbased detergent is $$\frac{H^1}{F} \times 100\,\%$$

The percentages (by mass) of the individual surfactants (in their free form, that is, not in the form of a salt or other derivative) based on the surfactant system can be predicted from the proportions of the surfactants used as starting materials, provided that the percentage of 'reactive ingredient' (r.i.) is known for each of the surfactant starting materials. The percentage of the total surfactants (in their free form) in the liquid overbased product can then be predicted, and the TBN: % surfactant ratio can be determined. As used herein, the term 'reactive ingredient' is the percentage by mass of surfactant that will be associated with the metal calcium.

Co-Additives

The marine diesel engine lubricant compositions may also contain other additives, for example dispersants, antioxidants, antifoaming agents and/or rust inhibitors as well as ash-forming antiwear additives, such as known in the art.

Other co-additives may include pour point depressants, otherwise known as lube oil flow improvers, which lower the minimum temperature at which the fluid will flow or can be poured and antifoamants of the polysiloxane type, for example, silicone oil or polydimethyl siloxane, to provide foam control.

Typical proportions for additives for a TPEO (a trunk piston engine oil) are as follows:

| Additive | Mass % a.i.* (Broad) | Mass % a.i.* (Preferred) |
|---|---|---|
| Detergent(s) | 0.5–12 | 2–8 |
| Dispersant(s) | 0.5–5 | 1–3 |
| Ashless Anti-wear agent(s) | 0.1–1.5 | 0.5–1.3 |
| 0xidation inhibitor | 0.2–2 | 0.5–1.5 |
| Rust inhibitor | 0.03–0.15 | 0.05–0.1 |
| Pour point depressant | 0.03–0.15 | 0.05–0.1 |
| Mineral or synthetic base oil | Balance | Balance |

*Mass % active ingredient based on the final oil.

Typical proportions for additives for a MDCL (a marine diesel cylinder lubricant) are as follows:

| Additive | Mass % a.i.* (Broad) | Mass % a.i.* (Preferred) |
|---|---|---|
| Detergent(s) | 1–20 | 3–15 |
| Dispersant(s) | 0.5–5 | 1–3 |
| Ashless Anti-wear agent(s) | 0.1–1.5 | 0.5–1.3 |
| Pour point depressant | 0.03–0.15 | 0.05–0.1 |
| Mineral or synthetic base oil | Balance | Balance |

*Mass % active ingredient based on the final oil.

EXAMPLES

The present invention is illustrated by, but in no way limited to, the following examples.

Test Method

The test method used was that described in 'Wear', 1996, 196, 207–213, and closely simulates wear mechanisms in the piston ring and cylinder liner areas of cross-head diesel engines.

Briefly described, the test is carried out using a pin-on-disc wear machine, using pins of diameter of 8 mm, giving a total contact area of 50.2 $mm^2$. A new pin geometry is employed to allow conformal surface contact between the pin and disc.

A ramping (step) test technique on the pin-on-disc machine was employed to identify transition pressures from mild to severe wear under boundary lubrication. Tests were carried out at sliding velocities of 0.5 and 2.0 m/s at room temperatures (20° C.), and 2.0 m/s at 250° C. disc temperatures. Daros RM4 grey cast iron piston ring materials were used as pins, tested against GG25 B+P grey cast iron (Table 1). Tests begin by applying a load of 100N on the pin and lubricant mist on the wear track. This represents a 5522 pressure of 2.0N/$mm^2$ on the pin with contact area of 50.26 $mm^2$. Load is then increased at regular intervals representing 600 m of sliding until transition from mild to severe wear takes place at which point the test is terminated. For the given test velocities the sliding interval is adequate to achieve a steady state.

Transition can be noted by an increase in frictional energy (i.e. frictional force, heat, vibration and noise). Furthermore, at this point the oxidative feature of the wear track changes locally to metallic. Tests are conducted under boundary lubrication (i.e. $0.1 \leqq \mu \geqq 0.3$). Using a pneumatic oil mister, the coefficient of friction is controlled during the starting stages of the test (during oxidative wear regime). Oil mist application can be regulated to achieve a steady state condition. The coefficient of friction remains constant under these conditions until transition from mild to severe wear occurs. The oil mist pressure, duration and intervals are adjustable and dependent on the lubricant characteristics. Table 1 shows the ramping test details.

TABLE 1

Parameters for Ramping Tests

| | |
|---|---|
| Wear Type Type: | Pin-on-disc |
| Pin Material: | Daros RM4 piston ring (Ra = 0.1 $\mu$m)<br>Pin Surface Area = 50.2 $mm^2$<br>(Standard NSD RTA piston ring material) |
| Disc Material: | GG25 B + P (Standard NSD liner material) |
| Applied Load: | Ramping, 100N up to transition (@ 100N intervals) |
| Ramp Interval: | 600 m of sliding |
| Sliding Velocity: | 0.5 and 2.0 m/s |
| Starting Disc Temperature | 20° C. and 250° C. |
| Total Sliding Time: | Depends on materials and lubricant |
| Lubricant Mist Dosage | RT: 0.45 mg/min.<br>HT: 2 mg/min. |

Daros RM4 piston ring is a standard Wärtsilä NSD RTA piston ring material.

GG25 B+P is a standard Wärtsilaä NSD liner material.

Components

A 410 TBN calcium detergent (P) was prepared as follows.

Toluene (selected from the range of from 350–540 g), methanol (selected from the range of from 270–330 g), and water (selected from the range of from 15–26 g) were introduced into a reactor and mixed while maintaining the temperature at approximately 20° C. Diluent oil (11 g) was also added and the mixture maintained at 20° C. Calcium hydroxide ($Ca(OH)_2$) (71 g) was added, and the mixture was heated to 40° C., with stirring. To the slurry obtained in this way was added a mixture, maintained at 40° C., of phenol, sulphonic acid, and toluene (100 g), followed by a further quantity (50 g) of toluene.

After neutralisation of the surfactants by the calcium hydroxide, the temperature of the mixture was reduced to approximately 28° C. and was maintained at approximately 28° C. while carbon dioxide (31 g) was injected into the mixture at a rate such that substantially all the carbon dioxide was absorbed in the reaction mixture to form the basic material. The temperature was then raised to 60° C. over 60 minutes, following which the mixture was cooled to a temperature of approximately 28° C. over 30 minutes. At 28° C., a further quantity of calcium hydroxide (63 g) was added and carbon dioxide (31 g) was charged. After this second carbonation step, the temperature was raised to 60° C. over 90 minutes.

Subsequently, the polar solvents were distilled off and the product was filtered to remove sediment. The remaining volatile material was then distilled off and diluent oil (122 g) was added.

The phenol used in the preparation above is a sulphurised alkyl phenol, synthesised from sulphur monochloride and a 65/35 (by mass) blend of tertiary nonyl (tripropylene) phenols (predominantly para-substituted) and tertiary dinonyl phenols (predominantly 2,4-substituted) (a.i.=84; r.i.=40); and the sulfonic acid used in the preparation above is an alkyl benzene sulfonic acid derived from $SO_3$ (in liquid $SO_2$) with a molecular mass of 683 (a.i.=96; r.i.=84).

The phenol and sulfonic acid were used in suitable quantities to obtain an overbased metal compound having a TBN of 410 and TBN:% surfactant ratio of 20.

The sulfur-containing borate ester (Q) was prepared as follows.

In a 5 liter, three neck flask, of hydroxyethyloctyl sulfide (2280 g; 12 mol) and boric acid powder (744 g; 12 mol) were combined. The flask was equipped with a stirrer, a thermometer and a condenser connected to vacuum. The flask was heated to 110° C., and pressure within the flask reduced to −70 kPa. After a few minutes water began to evolve. The temperature in the flask was allowed to fall to 100° C. at which point heating was terminated and the exothermic reaction proceeded unassisted until water (2 molar equivalents) evolved and was collected. Heat was then applied until water (one additional molar equivalent) evolved and was collected.

The product was characterized by a combination of analytical techniques. HPLC separation analysis showed that one primary species was formed. $^{13}C$ NMR Spectroscopy indicated that the material had a characteristic sharp single resonance associated with a borated alkoxy methylene carbon at 62.8(1C) ppm relative to TMS. $^{11}B$ NMR Spectroscopy showed only one boro-oxygen ester signal at −3 ppm relative to $H_3BO_3$. The simplicity of the carbon and boron NMR spectral result was indicative of a highly symmetric meta-boroester structure. Characteristic carbon signals associated with the incorporation of hydroxyethyloctyl sulfide were found at 33(1C), 31.8(1C), 31.2(1C), 29.6(1C), 28.8 (1C), 28.6(1C), 22.4(1C) and 13.6(1C).

A phosphorus-containing ashless anti-wear additive (R) in the form of PARABAR (RTM) 9450 additive, which is a commercially available ashless diaryldithiophosphate derivative.

Description of Oils

A—A lubricant composition containing base oil and of the order of 1.76 mass % of a commercially available zinc dialkyldithiophosphate (ZDDP).

B—A lubricant composition containing base oil, borated dispersant, 250 TBN calcium phenate and 300 TBN calcium sulfonate, the TBN and viscosity index of the lubricant composition being 72 and 95 respectively.

C—A set of lubricant compositions each containing base oil, borated dispersant and the 410 TBN calcium detergent (P) and having a TBN of 72. The viscosity index of the lubricant compositions varied between 110 and 116.

1—A lubricant composition containing base oil, additives of Example B and the sulfur-containing borate ester (Q) in an amount of 2.0 mass %. The TBN and viscosity index of the lubricant composition were 72 and of the order of 95 respectively.

2 —A lubricant composition containing base oil, additives of Example C and the sulfur-containing borate ester (Q) in an amount of 2.0 mass %. The TBN and viscosity index of the lubricant composition were 72 and of the order of 113 respectively.

3—A lubricant composition containing base oil, additive of Example C and the additive R in an amount of 1.60 mass %.

Oils A-C and 1–3 were tested on the pin-on-disc wear machine and the results are shown in Table 2. Transition pressure is a measure of the pressure at which the transition from a low to a high wear regime takes place and its values are taken as an indication of good wear control, i.e. higher values indicate better wear control.

TABLE 2

| | Transition Pressure, N/mm$^2$ | | |
|---|---|---|---|
| Disc Conditions | 20° C./ 0.5 ms$^{-1}$ | 20° C./ 2.0 ms$^{-1}$ | 250° C./ 2.0 ms$^{-1}$ |
| Comparative Examples | | | |
| A | —(a) | 15.7 | —(a) |
| B | 27.2(b) | 14.0(c) | 12.8(b) |
| C | 32.5(d) | 17.24(e) | 11.34(e) |
| Examples of the Present Invention | | | |
| 1 | 75 | 29 | 36(f) |
| 2 | 62.5(f) | 32.5(f) | 25.2(g) |
| 3 | 60 | 43.5 | 23.5 |

(a) No measurement taken.
(b) Average of five measurements.
(c) Average of four measurements.
(d) Average of thirteen measurements.
(e) Average of eleven measurements.
(f) Average of two measurements.
(g) Average of three measurements.

Comparative Example A shows the transition pressure of a composition containing ZDDP, a metal-containing antiwear additive.

Comparing Example 1 and Example B, transition pressure, hence wear control, is better in Example 1 in all three conditions of the test, including the high temperature/speed stage (250° C. and 2.0 ms$^{-1}$). This suggests that the addition of the ashless antiwear additive alone has improved the wear control of the lubricating oil.

A similar trend is observed for Examples 2 and 3 in comparison with Example C: the transition pressure is better on addition of the ashless antiwear additive.

Further, Examples 2 and 3 show good wear control when high TBN overbased metal compounds are used.

Also, Examples 1 and 3 reveal improved transition pressures over the comparative Example A which contained ZDDP.

What is claimed is:

1. A marine diesel engine lubricant composition having a TBN of at least 10 and a viscosity index of at least 90, the composition comprising a major amount of oil of lubricating viscosity:

(A) 0.1 to 10, mass %, based on the mass of the composition, of an ashless antiwear additive comprising a sulfur-containing boroester compound, being a borate ester having the general formula (I):

(I)

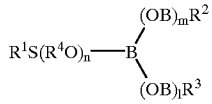

wherein $R^1$ represents a hydrocarbyl group having from 4 to 12 atoms, $R^2$ and $R^3$ independently represent —$(OR^4)_nSR^1$ or —$(OR^4)_nSR^1OH$; $R^4$ represents a hydrocarbyl group having from 1 to 6 carbon atoms; n is an integer of from 1 to 4; and l and m are independently 0, 1 or 2;

a cyclic metaborate ester having the general formula (II):

(II)

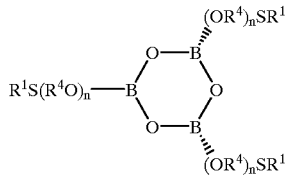

wherein n, $R^1$ and $R^4$, are defined as in formula (I); or a mixture of borate ester of formula (I) and a metaborate ester of formula (II);

a minor amount of (B) a metal detergent in the form of (i) an overbased metal detergent having a TBN at least 300 and comprising a surfactant system derived from at least two surfactants, and/or (ii) a metal detergent other than (i); and (C) optionally, an extreme pressure additive;

provided that if detergent (ii) is present, the composition does not contain more than 5.0 mass %, based on the total mass of the composition, of the optional extreme pressure agent.

2. The composition as claimed in claim 1 wherein an extreme pressure agent is absent.

3. The composition as claimed in claim 1 wherein the TBN of the composition is in the range of from 60 to 100.

4. The composition as claimed in claim 1 wherein the viscosity index is at least 120.

5. The composition as claimed in claim 1 wherein detergent (B) (ii) is an overbased metal detergent.

6. The composition as claimed in claim 5 wherein the overbased metal detergent has a TBN of at least 200 up to 600.

7. The composition as claimed in claim 1 wherein the metal in (B) is calcium.

8. The composition as claimed in claim 1 wherein (B) (ii) comprises at least two overbased metal detergents and the mass to mass proportion of any one such detergent to any other such detergent is in the range of from 5:95 to 95:5.

9. The composition as claimed in claim 8 wherein the mass to mass proportion is in the range of from 60:40 to 40:60.

10. The composition as claimed in claim 1 wherein the metal detergent is a phenate or a sulfonate.

11. A method of reducing the piston ring and cylinder liner wear of a marine diesel engine comprising lubricating the engine with a lubricant composition as claimed in claim 1.

12. The method of claim 11, wherein the marine diesel engine is a cross-head diesel engine.

13. A method of lubricating a marine diesel engine which comprises supplying to the engine a marine diesel engine lubricant composition as claimed in claim 1.

14. A method as claimed in claim 13 wherein the engine is supplied with a fuel having a sulfur-content, expressed as elemental sulfur, of not greater than 1.5 mass %.

15. The method of claim 13, wherein the marine diesel engine is a cross-head diesel engine.

16. A method of making a marine diesel engine lubricant composition having a TBN mixture of at least 10 and a viscosity index of at least 90, comprising blending a major amount of oil of lubricating viscosity;

(B) 0.1 to 10, mass %, based on the mass of the composition, of an ashless antiwear additive comprising a sulfur-containing boroester compound, being a borate ester having the general formula (I):

(I)

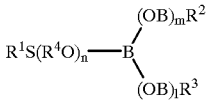

wherein $R^1$ represents a hydrocarbyl group having from 4 to 12 atoms, $R^2$ and $R^3$ independently represent —$(OR^4)_nSR^1$ or —$(OR^4)_nSR^1OH$; $R^4$ represents a hydrocarbyl group having from 1 to 6 carbon atoms; n is an integer of from 1 to 4; and l and m are independently 0, 1 or 2;

a cyclic metaborate ester having the general formula (H):

(II)

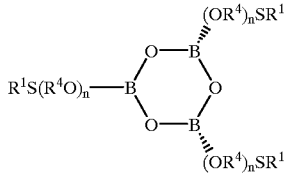

wherein n, $R^1$ and $R^4$, are defined as in formula (I); or a mixture of borate ester of formula (I) and a metaborate ester of formula (II);

a minor amount of (B) a metal detergent in the form of (i) an overbased metal detergent having a TBN at least 300 and comprising a surfactant system derived from at least two surfactants, and/or (ii) a metal detergent other than (i); and (C) optionally, an extreme pressure additive;

provided that, if detergent (ii) is blended, no more than 5.0 mass %, based on the total mass of the composition, of the optional extreme pressure additive is blended.

* * * * *

UNITED STATES PATENT AND TRADEMARK OFFICE

CERTIFICATE OF CORRECTION

PATENT NO. : 6,277,794 B1
DATED : August 21, 2001
INVENTOR(S) : A. Dunn

It is certified that error appears in the above-identified patent and that said Letters Patent is hereby corrected as shown below:

Column 21,
Line 11, delete the word "mixture"

Column 22,
Line 2, change "(H)" to -- (II) --.

Signed and Sealed this

Fourteenth Day of May, 2002

*Attest:*

*Attesting Officer*

JAMES E. ROGAN
*Director of the United States Patent and Trademark Office*